United States Patent [19]

Guidry et al.

[11] 4,454,913

[45] Jun. 19, 1984

[54] SAFETY VALVE SYSTEM WITH RETRIEVABLE EQUALIZING FEATURE

[75] Inventors: Shelby L. Guidry; Kerry D. Jernigan, both of Houston, Tex.

[73] Assignee: Schlumberger Technology Corporation, New York, N.Y.

[21] Appl. No.: 222,537

[22] Filed: Jan. 5, 1981

[51] Int. Cl.[3] ..... E21B 34/10

[52] U.S. Cl. ..... 166/117.5; 166/72; 166/322; 166/324

[58] Field of Search ..... 166/322, 324, 117.5, 166/375, 72

[56] References Cited

U.S. PATENT DOCUMENTS

| | | | |
|---|---|---|---|
| 3,059,700 | 10/1962 | Loy et al. | 166/224 |
| 3,666,012 | 5/1972 | Sizer et al. | 166/319 |
| 3,874,445 | 4/1975 | Terral | 166/117.5 |
| 3,882,935 | 5/1975 | Calhoun | 166/224 |
| 4,031,955 | 6/1977 | Leder | 166/117.5 |
| 4,031,960 | 6/1977 | Dudley | 166/317 |
| 4,119,146 | 10/1978 | Taylor | 166/72 |
| 4,325,431 | 4/1982 | Akkerman | 166/117.5 |

*Primary Examiner*—William F. Pate, III

[57] ABSTRACT

In accordance with an illustrative embodiment of the present invention, a surface controlled subsurface safety valve system includes a tubing retrievable safety valve having a valve element that is opened and held open in response to the pressure of a control fluid in a control line and automatically closed when control pressure is reduced, and means for equalizing the pressure of fluids above and below said valve element to aid in reopening the same after closure, including a wireline retrievable equalizing valve removably installed in the pocket of a side pocket mandrel that is connected in the tubing above said safety valve, said equalizing valve being arranged to be opened and closed in response to changes in the pressure of said control fluid. A uniquely constructed side pocket mandrel also is disclosed.

16 Claims, 5 Drawing Figures

FIG. 1
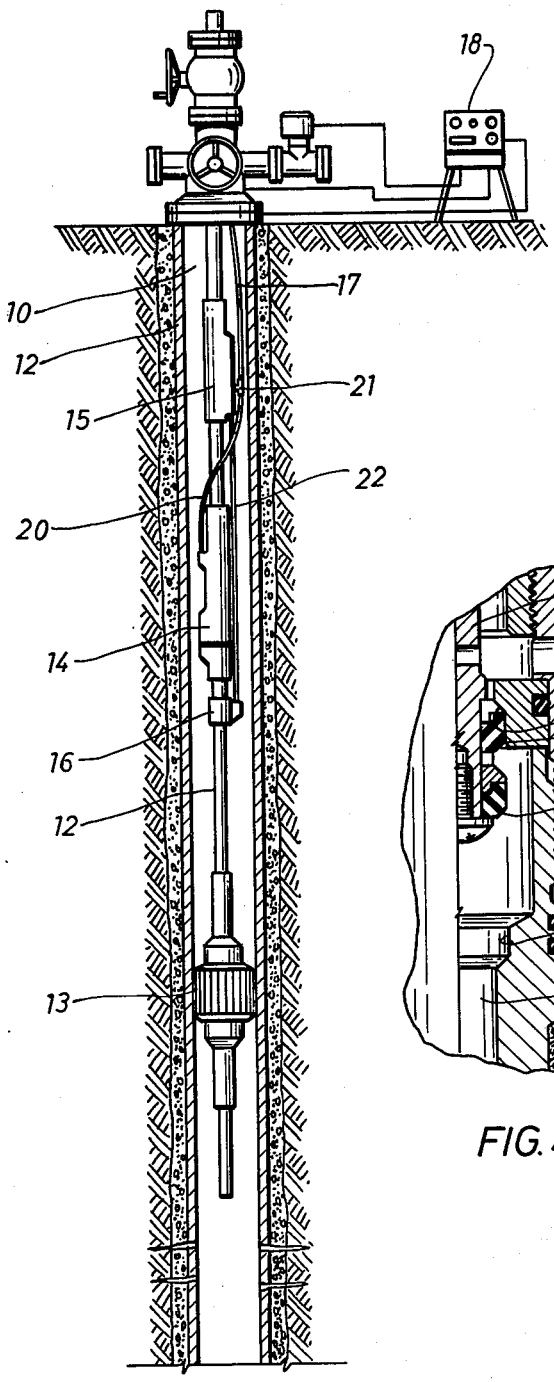
FIG. 2
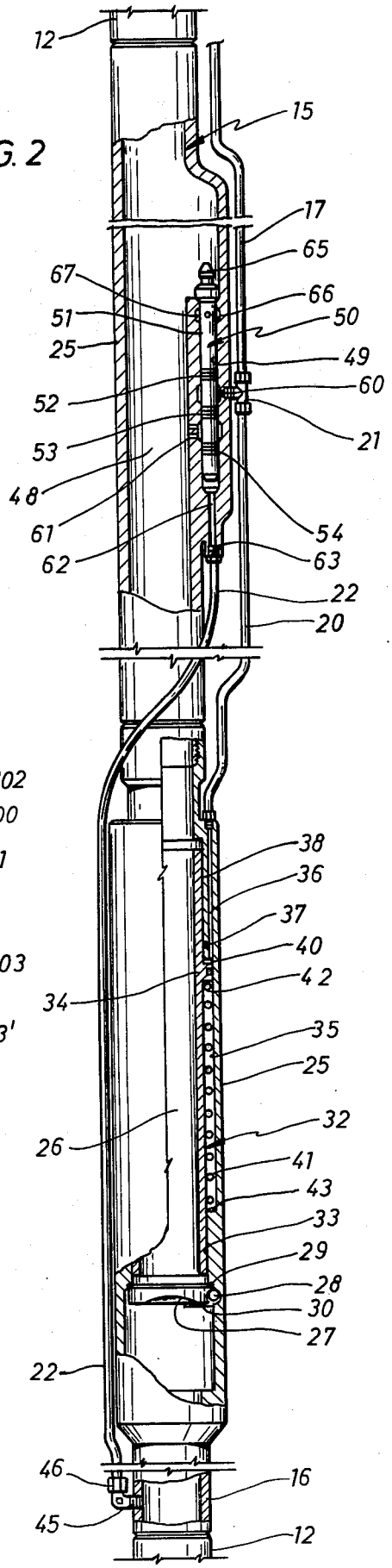
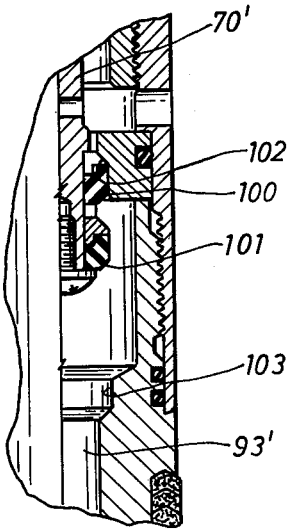
FIG. 4

SAFETY VALVE SYSTEM WITH RETRIEVABLE EQUALIZING FEATURE

FIELD OF THE INVENTION

This invention relates generally to subsurface safety valves, and particularly to a new and improved surface controlled subsurface safety valve system that includes a retrievable equalizing valve.

BACKGROUND OF THE INVENTION

Surface controlled subsurface safety valves commonly are installed in producing wells as a means of providing downhole protection against disasterous fires and blowouts due to failure, leakage or loss of surface equipment such as valves and flow lines. A safety valve of typical construction includes a body connected in the tubing and having a normally closed valve element that is held open in response to the pressure of fluid in a control line that extends outside the production tubing upwardly to a surface control unit. As long as the control line remains pressurized, the valve is open to the flow of production fluids. A reduction or loss of control line pressure due to the sensing of heat, collision or the like at the surface enables a coil spring to force a valve actuator in a direction to enable automatic closure of the valve element to shut in the well at the subsurface level of the safety valve.

Once closed, the valve element may be rather forcefully held against its seat because it is subjected to upward force due to the difference in pressures between production pressure and hydrostatic head of fluid in the tubing. To aid in reopening the valve element so that the well can be put back into production as soon as repairs have been made, an equalizing valve has been included that functions to equalize pressures above and below the valve element prior to opening the same by the application of control line pressure. In a known valve construction, the equalizing valve is in the form of a valve head on the actuator that engages a downwardly facing annular valve seat on the body to close off flow through an equalizing passage when the actuator is in the valve-closed position. Initial downward movement of the actuator in response to control line pressure moves the valve head off the seat to effect pressure equalization so that the valve element can be opened easily.

Although an equalizing valve is of considerable convenience to a well operator in putting the well back into production after the downhole safety valve has been closed, (either automatically as described above or deliberately for test purposes), it is subject to malfunction due to damage to the seal ring, cutting of the valve seat, and the like, as will be appreciated by those skilled in the art. When the equalizing valve becomes inoperable for any reason, the safety valve will not hold pressure due to leakage through the equalizing bypass passage. In order to repair the valve, it is necessary to pull the entire production string from the well, which is a time consuming, costly procedure that is highly undesirable.

It is the general object of the present invention to provide a new and improved subsurface valve system that includes an equalizing valve that can be retrieved to the surface for repair in the event of its malfunction without having to remove the safety valve or the production string from the well.

SUMMARY OF THE INVENTION

This and other objects are attained in accordance with the concepts of the present invention through the provision of a safety valve system comprising a tubing retrievable safety valve means connected in the tubing and adapted to be opened and held open by the pressure of a control fluid and automatically closed when such pressure is reduced. The system further includes means for equalizing the pressure of fluids in the tubing above and below the safety valve to aid in reopening it after closure, said equalizing valve means including a wireline retrievable valve means that is removably installed in the tubing above the safety valve means. The equalizing valve also is arranged to be opened and held open by the pressure of a control fluid and automatically closed when control pressure is reduced, and may be connected commonly with the source of pressure that is employed to operate the tubing retrievable safety valve.

In a preferred embodiment, the equalizing valve is placed in the pocket of a uniquely constructed side pocket mandrel that is connected in the tubing string, with the equalizing valve being constructed and arranged to control flow through an equalizing conduit that extends from the pocket to a location in communication with the tubing bore below the safety valve. In the event of malfunction of the equalizing valve for any reason, it can be retrieved to the surface for repair or replacement using conventional wireline techniques while the safety valve and the tubing string remain in place in the well.

BRIEF DESCRIPTION OF THE DRAWINGS

The present invention has other features and advantages which will become more clearly apparent in connection with the following detailed description of a preferred embodiment taken in conjunction with the appended drawings in which:

FIG. 1 is a schematic view of a producing well installation having a safety valve system in accordance with the present invention incorporated therein;

FIG. 2 is a longitudinal cross-sectional view, with portions in side elevation, of a tubing retrievable safety valve positioned below a side pocket mandrel having a retrievable equalizing valve installed therein;

FIG. 4 is a fragmentary view of an alternative embodiment of an equalizing valve element and seat arrangement in accordance with the present invention.

DESCRIPTION OF A PREFERRED EMBODIMENT

Figure 3A:
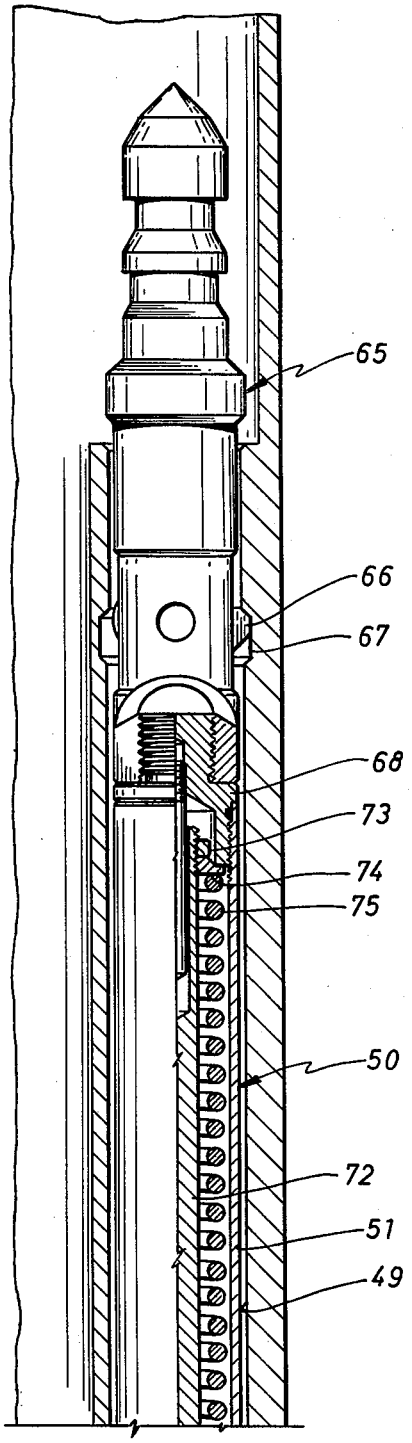
FIGS. 3A and 3B are longitudinal sectional views to illustrate the structural details of the retrievable equalizing valve.

Referring initially to FIG. 1, a somewhat schematic illustration of a well installation that incorporates a safety valve system in accordance with the present invention is shown. A well bore 10 lined with casing 11 has a production string of tubing 12 that extends from the surface down to a packer 13 which is set to isolate a production interval therebelow. A tubing retrievable subsurface safety valve 14 is connected in the tubing 12 below a side pocket mandrel 15 and above an equalizing sub 16. A small diameter control line 17 extends from a surface control unit 18 down through the annulus between the tubing 12 and the casing 11 and is connected to a fitting 21 on the side of the mandrel 15, and a continuing section 20 of the line extends from the fitting 21 to the safety valve 14. Another section 22 of hydraulic line extends from a connection 23 near the lower end of the side pocket mandrel 15 down to the equalizing sub 16.

The control lines 17 and 20 furnish pressurized control fluid to the safety valve 14 to hold it open and permit well fluids to flow upwardly through the tubing 12 to the surface where they may be conveyed to a gathering facility through a flow line (not shown). The surface control unit 18 is arranged in a typical manner to automatically relieve the pressure in the control lines 17 and 20 in response to high or low pressure conditions in the flow line or in response to other abnormal surface conditions relating to fire, storm, impact and the like. The release of pressure in the lines enables the safety valve 14 to close and shut in the production tubing at its subsurface location.

The safety valve 14 is shown in further detail in FIG. 2. The safety valve 14 includes a tubular body 25 defining a flow passage 26 and having its upper and lower ends threaded to the tubing 12. A flapper valve 27 is hinged to the body 25 by a pin 28 and is moveable from an open position to the side of the passage 26 to a closed position against the lower side of a valve seat 29 that surrounds the flow passage. A hinge spring 30 or the like biases the flapper element 27 toward the closed position at all times.

A tubular actuator 32 is mounted in the body 25 for longitudinal movement between an upper position where the flapper valve 27 can swing closed and a lower position where the lower end portion 33 thereof extends through the seat 29 to hold the valve in the open position. The actuator 32 is provided with an outwardly directed annular piston 34 that is sealingly slidable with respect to an inner wall 35 of the body 25 below an inlet port 36 through which control fluid under pressure is supplied. A seal ring 37 on the body 25 engages the outer surface 38 of the actuator 32 above the piston 34 to define a chamber 40 that is increased in capacity as the actuator shifts downwardly and reduced in capacity as the actuator shifts upwardly. A coil spring 41 surrounds the actuator 32 and reacts between the downwardly facing shoulder 42 thereon and an upwardly facing shoulder 43 on the body 25 to bias the actuator in the upward direction.

The safety valve 14 operates essentially as follows. Control fluid under pressure supplied to the chamber 40 acts on the upper face of the piston 34 to force the actuator 32 downwardly against the bias of the spring 41 to the lower position where the lower end portion 33 of the actuator extends through the valve seat 29 to push the flapper element 27 to the open position. The flapper element 27 is retained in such open position so long as an appropriate control pressure is maintained in the chamber 40. On the other hand, if control fluid pressure is reduced, the spring 41 pushes the actuator 32 upward to cause its lower end to be withdrawn from the valve seat 29, whereupon the hinge spring 30 pivots the valve element 27 upwardly against the seat to close the flow passage 26 against upward flow of well fluids.

The equalizing sub 16 which is connected in the tubing 12 below the safety valve 14 may be in the form of a tee having its upper and lower ends threaded to the tubing and having a port 45 extending through the side wall thereof and communicating with a lug 46 to which the equalizing conduit 22 is coupled by threads or the like.

The side pocket mandrel 15 which has threads (not shown) at each end for connecting the same in the tubing 12 above the safety valve 14 includes a body 25 having an open bore 48 therethrough and an open-topped pocket 49 to the side of, and laterally offset from, the open bore. The pocket 49 is adapted to receive an equalizing valve assembly 50 including a body 51 which carries three sets of vertically spaced packing elements 52–54 which sealingly engage reduced diameter polish bore surfaces 56–58 within the pocket 49. The upper and middle packing elements 52, 53 seal above and below an inlet port 60 which extends to the outside of the pocket 49 and is communicated by fitting 21 that is threaded or welded (or the like) to the pocket wall and is coupled to the control lines 17 and 20. The middle and lower packing elements 53, 54 seal above and below a plurality of ports 61 which extend through the inner wall of the pocket 49 to communicate the interior thereof with the bore 40 of the mandrel 15. An opening 62 also is provided in the bottom of the pocket 49 and leads to a threaded socket 63 to which the upper end of the equalizing conduit 22 is connected.

The upper end of the body of the equalizing valve 50 is closed by a plug that is threaded to a running and retrieving head 65. The head 65 carries a pivotally mounted latch 66 which engages in a detent groove 67 near the upper end of the pocket 49. A suitable head and latch that may be used is the "R" latch commercially available from Camco, Inc., Houston, Tex., although other latches of this general type may be used, as will be apparent to those skilled in the art. This structure enables the equalizing valve assembly 50 to be run into the tubing 12 and set in the pocket 49, and to be removed therefrom, by use of a conventional kickover tool of the type shown in U.S. Pat. No. Re 29,870. The kickover tool, of course, is manipulated and used in the well employing known wireline running and retrieving techniques.

Figure 3B:
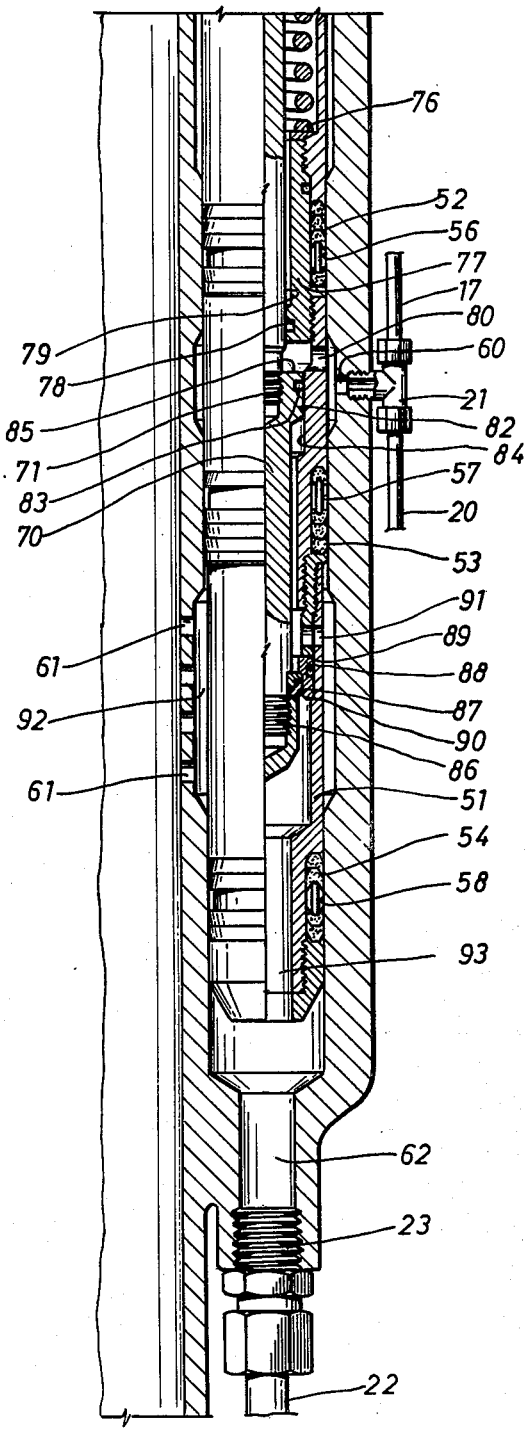

Turning now to FIGS. 3A and 3B for further details of the equalizing valve assembly 50, the body 51 is generally hollow and receives a plunger 70 having its upper end threaded at 71 to an elongated stem 72. The stem 72 has a nut 73 threaded to its upper end which provides a downwardly facing shoulder 74 that is engaged by a coil spring 75 whose lower end engages an upwardly facing shoulder 76 on the body 51. The body 51 is inwardly thickened in the region 77 of the upper packing element 52 and carries a seal ring 78 which slidably engages the outer surface 79 of the stem 72 above a flow port 80 which extends through the body wall. The valve plunger 70 has an outwardly directed flange 82 at its upper end which carries a seal ring 83 that slidably engages the adjacent inner wall surface 84 of the body 51. The difference in the diameters of sealing engagement of the seals 78 and 83 provides an upwardly facing transverse surface area 85 that is subject to the pressure of control fluid in the line 17 via the port 80 so the control pressure can be applied to shift the plunger 70 downwardly against the bias of the coil spring 75. Of course, a release of control pressure will enable the spring 75 to shift the valve stem and plunger upwardly.

The lower end portion 86 of the plunger 70 constitutes the valve head that carries an annular seal 87 which is engageable with a seat ring 88 fixed to the body 51 between opposed shoulders 89, 90 thereon. A plurality of flow ports 91 extend through the wall of the body 51 above the seat ring 88 and communicate the interior of the body with the region 92 outside adjacent the flow ports 61 in the wall of the pocket 49. The lower end of the body 51 is completely open at 93 to communicate the interior of the body below the seat ring 88 with the port 23 at the lower end of the pocket 49.

OPERATION

In operation, the safety valve 14, equalizing sub 16 and the side pocket mandrel 15 containing the equalizing valve 50 are connected in the tubing 12 above the packer 13 with the control lines 17, 20 and the equalizing conduit 22 connected as shown in the drawings. Under normal conditions of well production, the pressure of the control fluid in the lines 17, 20 maintains the actuator 32 of the safety valve 14 in its lower position where the flapper element 27 is open, and the plunger 70 of the equalizing valve 50 is in its lower open position. Should the pressure in the control lines 17, 20 be reduced due to a change in circumstances at the surface, the closing spring 41 of the safety valve 14 will shift the actuator 32 upwardly to enable the flapper valve 27 to close, and the closing spring 75 of the equalizing valve 50 will shift the plunger 70 upwardly to close off communication between the bore 48 of the mandrel 15 and the equalizing conduit 22. With both valves closed, the well is shut in at the subsurface location of the valves whereby the well cannot produce. The difference in the pressure of the production fluids and the pressure of the fluids standing in the tubing above the safety valve 14 holds the flapper valve element 27 tightly against its seat 29.

To reopen the safety valve 14 when it is desired to put the well back into production, the control line 17 is pressurized at the surface. Such pressure acts downwardly on the upper face 85 of the equalizing valve piston 82 to shift the valve plunger 70 downward to its open position so that the interior of the tubing 12 below the safety valve 14 is communicated with the interior of the tubing thereabove via the equalizing sub 16, the equalizing conduit 22 and the ports 91. Thus the opening of the valve 50 effects an equalization of pressures above and below the flapper element 27 which then is opened readily by downward movement of the actuator 32 under the influence of pressure acting on the upper face of the piston 34.

Should the equalizing valve 50 become inoperable due to seal ring failure or the like, it can be retrieved to the surface for repair. A kickover tool equipped with a retrieving head can be run into the tubing 12 on wireline and manipulated in an appropriate manner to latch onto and release the latch head 65 at the upper end of the equalizing valve 50, thereby enabling the valve to be removed from the pocket 49. Another equalizing valve assembly 50 can be run in and seated in the side pocket mandrel 15 so that the well can be put back into production in short order.

Another preferred embodiment of a valving arrangement for the wireline retrievable equalizing valve 50 is shown in FIG. 4. The stem 70' carries upper and lower seal rings 100 and 101 that respectively cooperate with upper and lower vertically spaced seats 102 and 103 in order to prevent flow through the port means 93' in both the upper and the lower positions of the valve stem. This valve arrangement is responsive to control fluid pressure in the same manner as in the embodiment previously described, however the valve moves from an upper closed position to an intermediate open position and then to a lower closed position. As pressure is applied to the piston surface 85, the valve head is moved away from the upper seat 102 to effect pressure equalization across the flapper valve 27 to enable it to be easily opened, and then the head closes against the seat 103 to again close the equalizing conduit 22. This embodiment has the advantage of preventing any flow or well fluids through the equalizing conduit 22 while the safety valve 14 is open during normal production operations.

It now will be recognized that a new and improved safety valve system has been provided that includes a tubing retrievable safety valve in combination with a wireline retrievable equalizing valve so that in case of malfunction of the equalizing valve, it can be replaced quickly using standard wireline techniques without having to incur the expense and lost time involved in pulling the entire production string from the wall.

Various changes or modifications may be made in the disclosed embodiments without departing from inventive concepts involved. For example, separate control lines could be used to actuate the safety valve and the equalizing valve, or the control lines 17 and 20 could be eliminated entirely and annulus pressure used to control the valves. Of course, the safety valve 14 can have another type of closure element such as ball, a plug or a puppet device, and other types of actuators may be used. Thus, it is the aim of the appended claims to cover all such changes and modifications falling within the true spirit and scope of the invention.

What is claimed is:

1. A safety valve system for use in a well having a packer isolating an interval of the well and a production string of tubing therein, for delivering produced fluids from the isolated interval to the well surface through a bore in the tubing string, comprising:

safety valve means connected in the tubing string, said safety valve means including a closure member, said closure member being mounted on said tubing string and being adapted to be opened and held open by the pressure of a control fluid and automatically closed to shut said tubing string bore when said pressure is reduced; said packer and closure member serving to define a first portion of the well above said packer and closure member and a second portion of the well below said packer and closure member; and conduit means for providing fluid communication other than through said bore between the first and second portions of the well, said conduit means including a wireline retrievable valve means removably installed in the tubing string above said closure member, said wireline retrievable valve means being opened and closed in response to the pressure of a control fluid;

whereby communication of fluids through said conduit means between said first and second portions of the well is shut off by said wireline retrievable valve means when said tubing mounted closure member is closed.

2. The safety valve system of claim 1 further including a mandrel connected in the tubing string above said closure member, said wireline retrievable valve means being removably installed in said mandrel.

3. The safety valve system of claim 2 wherein said mandrel has an open bore therethrough and an open-topped pocket therein offset from said open bore, said pocket being arranged to receive said wireline retrievable valve means.

4. The safety valve system of claim 1 wherein said conduit means includes a conduit extending externally of the tubing string.

5. The safety valve system of claim 2 further including means for commonly communicating said safety valve means and said wireline retrievable valve means with a source of control fluid pressure at the top of the well; whereby said reduction in pressure causing said automatic closure of said safety valve means also causes automatic closure of said conduit means.

6. The safety valve system of claim 3, wherein said pocket has first, second and third openings in the walls thereof; and wherein said wireline retrievable valve means is adapted to be removably installed in said pocket, for controlling the communication of fluid applied at said first and second openings in response to the pressure of a control fluid applied at said third opening from a source of control fluid located at the surface of the well, said wireline retrievable valve means comprising: a tubular body having longitudinally spaced first, second and third flow ports positioned to generally align respectively with said first, second and third openings when the assembly is installed in said pocket and formed with an internal passageway to fluidly connect said first and second ports; an annular valve seat in said body between said first and second flow ports; stem means extending through said valve seat and providing a valve head that is movable from an open position away from said seat in which said passageway is open to a closed position against said seat in which said passageway is closed; means for biasing said stem and valve head toward said closed position; hydraulically operable means for moving said stem and valve head to said open position in response to application of said control fluid pressure to said third port; packing means carried on said body and disposed to prevent fluid communication within said pocket between said first, second and third openings, except through said body and sealing means, thereby preventing fluid transfer within said body between said third port and said passageway.

7. The safety valve system of claim 6 further including latch means on one end of said body for releasably securing said wireline retrievable valve means in said pocket.

8. A safety valve system adapted for use in a well having a production string of tubing therein comprising:

tubing retrievable safety valve means connected in the tubing string, said safety valve means being adapted to be opened and held open by the pressure of a control fluid in a control line extending upwardly along the tubing string to a source of fluid pressure located at the top of the well, said safety valve means being automatically closed when the pressure of said contol fluid is reduced;

a side pocket mandrel connected in the tubing string above said safety valve means, said mandrel having an open bore therethrough and an open-topped pocket laterally offset from said open bore;

first port means for communicating a lower portion of said pocket with said bore;

second port means for communicating the lower end or said pocket with the exterior of said mandrel;

an equalizing conduit connecting said second port means with the bore of the tubing string below said safety valve means; and wireline retrievable equalizing valve means removably installed in said pocket for controlling communication between said first and second port means in response to the pressure of said control fluid.

9. The safety valve system of claim 8 wherein said equalizing valve means includes a tubular body having longitudinally spaced flow ports defining the ends of a flow passage extending through said valve body; first and second annular valve seats surrounding said flow passage, and a valve element movable with respect to said seats between positions opening and closing said flow passage.

10. The safety valve system of claim 9 wherein said valve element includes a stem extending through said first valve seat; hydraulically operable piston means on said stem sealingly slidable within cylinder means in said body; a port through the wall of said body adjacent said piston means for cummunicating control fluid pressure thereto to enable said pressure to shift said valve element from a first closed position against said first valve seat to an open position between said seats and then to a second closed position against said second valve seat; and spring means continuously urging said valve elements toward said first closed position.

11. The safety valve system of claim 10 further including third port means extending through the wall of said pocket and communicating with said body port; and means associated with said third port means for connecting same with said control line.

12. The safety valve system of claim 11 wherein said pocket has an annular seal surface therein between said first and second port means, said body having first packing means disposed between said longitudinally spaced flow ports and arranged to sealingly engage said annular seal surface.

13. The safety valve system of claim 12 wherein said pocket has additional annular seal surfaces therein located above and below said third port means; said body having second and third packing means disposed respectively above and below said body port and arranged to sealingly engage said additonal seal surfaces.

14. The safety valve system of claim 13 further including downwardly facing shoulder means adjacent the open top of said pocket; and latch means on the upper end of said body cooperable with said shoulder means for releasably securing said equalizing valve means in said pocket.

15. A safety valve system adapted for use in a well having a packer isolating an interval of the well and a production string of tubing therein for delivering produced fluids from the isolated interval to the well surface, comprising:

tubing retrievable safety valve means connected in the tubing string, said safety valve means being adapted to be opened and held open by the pressure of a control fluid in a control line extending upwardly along the tubing string to a source of fluid pressure located at the top of the well, said safety valve means being automatically closed when the pressure of said control fluid is reduced; said packer and safety valve means serving to define a first portion of the well above said packer and safety valve means and a second portion of the well below said packer and safety valve means;

a side pocket mandrel connected in the tubing string above said safety valve means, said mandrel having an open bore therethrough and an open-topped pocket laterally offset from said open bore;

first port means for communicating a lower portion of said pocket with a point in the first portion of the well;

second port means for communicating the lower end of said pocket with the exterior of said mandrel;

a conduit connecting said second port means with a point in the second portion of the well and wireline retrievable valve means removably installed in said pocket for controlling communication between said first and second port means in response to the pressure of said control fluid; whereby said reduction in pressure causing automatic closure of said safety valve means causes automatic closure of communication between said first and second port means.

16. For use in combination with a safety valve system for a well having a packer isolating an interval of the well; a string of tubing with a bore for delivering produced fluids from the isolated interval to the surface; a closure member mounted in the tubing string for opening and closing the bore, the closure member being biased toward its closed position and being responsive to the supply of control fluid from a remote source thereto for moving the closure member to its open position; the well being divided into a first portion above the packer and the closure member and a second portion below the packer and the closure member; and the closure member serving to shut off communication of fluids through said bore between the first and second portions; the apparatus comprising:

conduit means to provide fluid communication other than through said bore between the first and second portions of the well;

a mandrel positioned within the tubing string above said closure member and having a side pocket therein; and a wireline retrievable valve assembly adapted to be positioned within the side pocket of the mandrel for opening and closing the conduit means in response to supply of control fluid, whereby the valve assembly serves to close the conduit means when the closure member is closed.

* * * * *